United States Patent [19]

Newton et al.

[11] 4,392,501

[45] Jul. 12, 1983

[54] METHOD OF PROCESSING FRESH TOBACCO LEAVES

[75] Inventors: Richard P. Newton, Prospect; Patrick H. Harper, Louisville, both of Ky.; Vernon L. Geiss, Georgetown, Ind.; John N. Jewell, Louisville, Ky.

[73] Assignee: Brown & Williamson Tobacco Corporation, Louisville, Ky.

[21] Appl. No.: 280,189

[22] Filed: Jul. 6, 1981

[51] Int. Cl.[3] ..... A24B 3/00; A24B 3/18; A24B 3/10; A24B 7/00

[52] U.S. Cl. ..... 131/300; 131/290; 131/297; 131/298; 131/303; 131/311

[58] Field of Search ..... 131/290, 292, 296, 297, 131/298, 299, 300–310, 311, 312, 313

[56] References Cited

U.S. PATENT DOCUMENTS 2,758,603 8/1956 Heljo ..... 131/299

3,785,385 1/1974 Johnson ..... 131/292

*Primary Examiner*—V. Millin

*Attorney, Agent, or Firm*—Charles G. Lamb

[57] ABSTRACT

Freshly cut tobacco leaves are processed wherein the processing includes particle size reduction and drying immediately upon harvesting.

11 Claims, 1 Drawing Figure

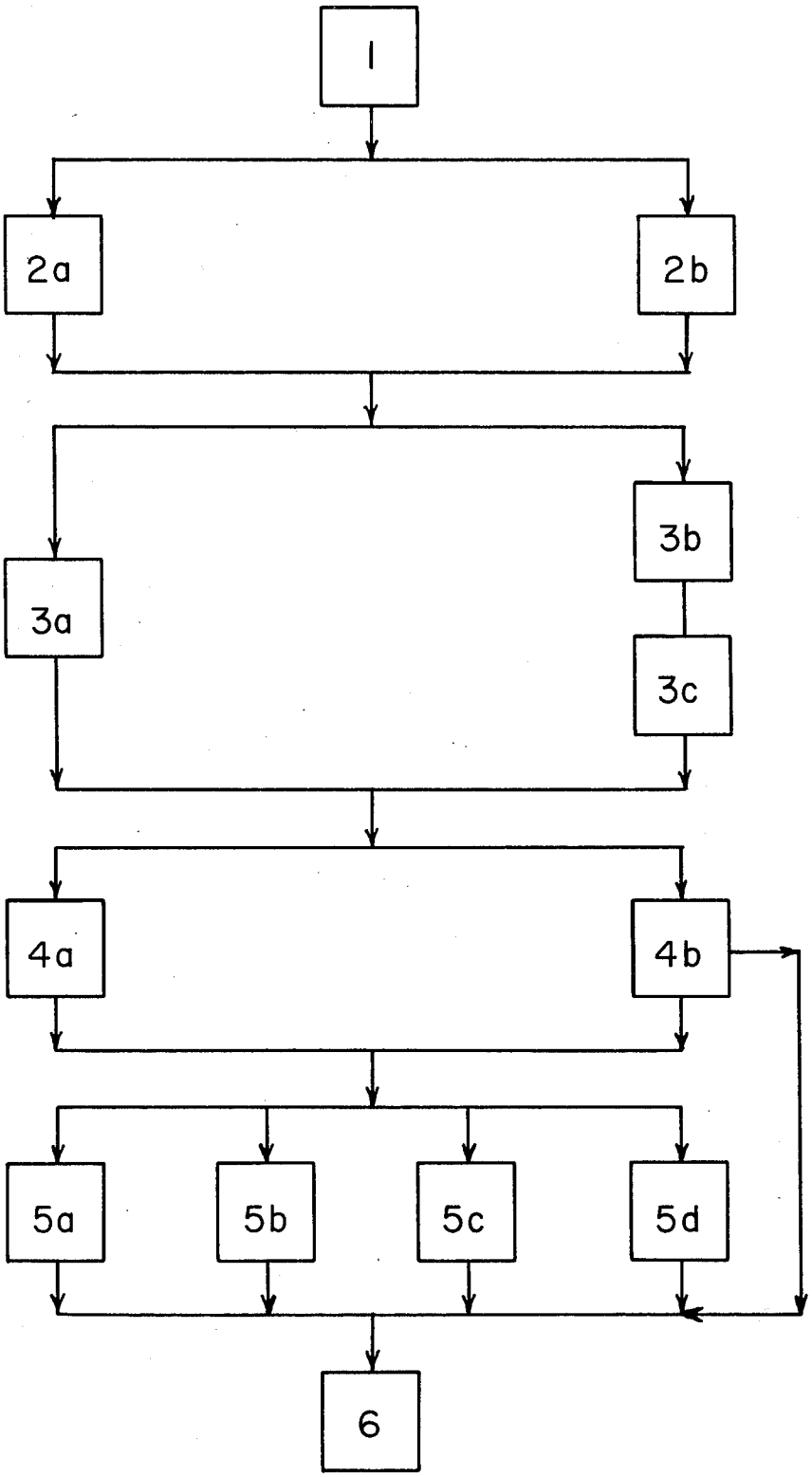
1
2a
2b
3a
3b
3c
4a
4b
5a
5b
5c
5d
6

METHOD OF PROCESSING FRESH TOBACCO LEAVES

BACKGROUND OF THE INVENTION

1. Field of the Invention

The present invention relates to a method and apparatus for treating tobacco leaves. More particularly, the invention relates to a method and apparatus for treating freshly harvested tobacco leaves wherein the tobacco leaves can be processed from the field directly into a usable smoking product.

2. Description of the Prior Art

It is well known in the art to take tobacco from the fields and then subject it to curing conditions. The cured tobacco, generally referred to as "green tobacco" or "raw tobacco," is then subjected to subsequent processing operations, including midrib removal, redrying, aging, and particle size reduction. The resulting tobacco is then manufactured into a smoking article. Examples of the aforementioned include U.S. Pat. No. 3,409,025 and U.S. Pat. No. 3,799,176. However, there has not been a means disclosed for taking freshly harvested tobacco and processing the fresh tobacco into a product which can be used as a smoking article immediately upon harvesting.

SUMMARY OF THE INVENTION

It is an object of the present invention to provide a novel method of treating freshly harvested tobacco leaves for use in smoking articles. Another object of the invention is to provide a novel method of drying freshly harvested tobacco leaves having a high moisture content herein. A further object of the invention is to provide a tobacco processing means for processing freshly harvested tobacco into a usable state for smoking articles without curing.

Various other objects of the present invention will become obvious to those skilled in the art upon reading the disclosure set forth hereinafter.

More particularly, the present invention is directed to a method for processing freshly harvested tobacco comprising the steps of: (a) reducing the particle size of the harvested tobacco into a preselected size; and, (b) drying the tobacco, said steps being completed without the natural curing of the tobacco.

BRIEF DESCRIPTION OF THE DRAWING

Referring to the drawing:

The FIGURE is a schematic flow diagram for processing freshly harvested tobacco into a usable tobacco product.

DESCRIPTION OF THE PREFERRED EMBODIMENT

Referring to the Figure in carrying out the present invention, tobacco growing in the field identified by block 1 is harvested either as mature leaves, block 2a, or as an immature whole plant, block 2b. The harvested tobacco which is from 65 to 90 percent moisture by weight is immediately cut. The cutting may take the form of small squares or strands, block 3a, or the midribs may be removed from the lamina, block 3b, and the lamina is subsequently cut, block 3c, to appropriate size for use in a finished tobacco product. It is realized that other means for particle size reduction may also be used without departing from the scope and spirit of this invention.

The cut tobacco is then either dried or subjected to other treatments prior to drying. For example, as shown by block 4a, the tobacco may be subjected to a microbial treatment for removal of nicotine, nitrates, and the like prior to drying. Also cut tobacco could be submitted to various extraction techniques at block 4b with the extracts being added back to the dried tobacco at block 6 with the resulting solids being subjected to drying as noted in blocks 5a, 5b, 5c, and 5d, to be described hereinafter. However, as noted by the diagram, these intermediate treatments may not be desired and the high moisture, fresh cut tobacco may then be subjected to any of the drying processes presently known in the tobacco art. For example, the cut tobacco may be freeze dried, block 5a; air dried, block 5b; high absolute humidity dried, block 5c; or, a combination of these drying methods, block 5d.

In freeze drying (block 5a) the tobacco is generally subjected to conditions which produce a frozen product in as short a time as possible. The frozen tobacco product is generally stored in a room controlled usually at from −15° C. to −20° C. until ready for drying. The drying is carried out by sublimation.

In the air drying, block 5b, one preferred method is to subject the tobacco to a controlled temperature and relative humidity range, usually in the neighborhood of 60° F. to 100° F., preferably about 80° F., at a relative humidity of usually at least 50 percent and preferably about 60 percent. The tobacco is maintained at the aforementioned temperature and relative humidity until a preselected moisture content is obtained. It is also realized that the air drying may be utilized for only a partial removal of the moisture and the tobacco may be subjected to further drying techniques.

Under high absolute humidity drying conditions (block 5c), drying is carried out as described in U.S. Pat. No. 4,167,191. In particular, drying in the system described in the aforementioned patent is carried out in a plurality of passes generally at a wet bulb of 210° F., (at least 165° F.) and a dry bulb of 600° F. (at least 280° F.) with a residence time in the dryer of approximately seven seconds (at least five seconds) for each pass.

The dried tobacco, generally having from about 3 to 20 percent moisture by weight, is then ready for use, block 6, or storage for later use.

A more comprehensive understanding of the invention can be obtained by considering the following examples. However, it should be understood that the examples are not intended to be unduly limitative of the invention.

EXAMPLE 1

Mature tobacco leaves having a moisture content of about 86 percent by weight was harvested from Virginia tobacco plants. The natural turgor of the leaves was maintained by storing them in humid refrigerated conditions at 3° C. to 4° C. for about 16 hours. The midribs were removed by a machine designed to strip them from the lamina, one example being disclosed in U.S. Pat. No. 4,237,909, entitled "Method and Apparatus for Tobacco Leaf Destemming." The lamina was then cut using a commercially available paper shredder. The shredded tobacco was immediately dried with three passes through a pneumatic air dryer provided with a steam supply. The conditions for drying were about 700° F. dry bulb temperature and 210° F. wet bulb temperature for the first pass; 650° F. dry bulb temperature and 210° F. wet bulb temperature for the second pass; and 400° F. dry bulb temperature and 210° F. wet bulb temperature for the third pass. The residence time in the dryer was about seven seconds for each pass. The high absolute humidity dryer utilized is disclosed in U.S. Pat. No. 4,167,191.

The resulting product was then analyzed for filling capacity and moisture. Filling capacity of the tobacco was measured and compared with that found when tobacco from the same source is cured by conventional methods, cut and dried. The results are shown in Table I. The method of measuring fill values applied gives results in volume occupied (cc) per gram. Thus, higher values indicate higher fill value.

TABLE I

| | Fill Value (cc/gm) | Moisture (%) |
|---|---|---|
| Processed Fresh Tobacco - Before Drying | 15.47 | 86.0 |
| Processed Fresh Tobacco - Dried | 11.92 | 13.2 |
| Conventionally Processed | 6.06 | 11.0 |

It can be seen that in the processed fresh tobacco the fill value was higher than the product made from conventionally cured tobacco.

EXAMPLE 2

Burley tobacco at 90 percent moisture was processed exactly as the tobacco processed in Example 1 except the conditions for drying in the pneumatic air dryer were changed. In this example, three passes were made through the dryer at 550° F. dry bulb temperature and 206° F. wet bulb temperature for each pass. The residence time for each pass was about seven seconds. Analyses were performed as in Example 1, the results being shown in Table II.

TABLE II

| | Fill Value (cc/gm) | Moisture (%) |
|---|---|---|
| Processed Fresh Tobacco - Before Drying | 19.72 | 90.0 |
| Processed Fresh Tobacco - Dried | 9.07 | 4.3 |
| Conventionally Processed | 5.94 | 9.7 |

It can be seen that in the processed fresh tobacco the fill value was higher than those products made from conventionally cured tobacco.

EXAMPLE 3

Burley tobacco at 88 percent moisture was processed exactly as in Example 1 except that following cutting of the fresh leaf, it was quick frozen from ambient conditions to between −15° C. and −20° C. within ten minutes and maintained in this frozen condition until ready for further processing. The tobacco was then dried at less than 0.1 mm. of mercury at less than −60° C. for twenty-four hours in a Virtis Freeze Dryer. Analyses were performed as in Example 1 giving the results shown in Table III.

TABLE III

| | Fill Value (cc/gm) | Moisture (%) |
|---|---|---|
| Processed Fresh Tobacco - Before Drying | 15.64 | 88.0 |
| Processed Fresh Tobacco - Dried | 15.44 | 11.8 |
| Conventionally Processed | 5.94 | 9.7 |

It can be seen that in the processed fresh tobacco, fill values were higher than those products made from conventionally cured tobacco.

EXAMPLE 4

Burley tobacco at about 84 percent moisture was processed exactly as in Example 1 except that following shredding, the tobacco was dried by spreading it in a thin layer (one to two inches in thickness) and allowing it to air dry at about 80° F. and 60 percent relative humidity. The tobacco was dried to about 8 percent moisture, in two days with turning and mixing at irregular intervals. Analyses were performed as in Example 1, and the results obtained are shown in Table IV.

TABLE IV

| | Fill Value (cc/gm) | Moisture (%) |
|---|---|---|
| Processed Fresh Tobacco - Before Drying | 16.22 | 84.0 |
| Processed Fresh Tobacco - Dried | 8.17 | 8.0 |
| Conventionally Processed | 5.94 | 9.7 |

It can be seen that in the processed fresh tobacco, fill values were higher than those products made from conventionally cured tobacco.

EXAMPLE 5

A blend of the processed fresh tobaccos (PFT) dried under high absolute humidity (U.S. Pat. No. 4,167,191) conditions were prepared. The blend included equal amounts of Virginia and burley tobaccos. Within these types, equal amounts were included from each stalk location. One part of this blend was in turn mixed with nine parts of a blend commonly used in cigarette production. This mixture was used to make cigarettes. The cigarettes were evaluated and compared with cigarettes made entirely from the commonly used blend. Subjective examination by smoke panels showed no significant differences between the samples. Other results are shown in the following Tables.

TABLE V(a)

Physical evaluation of cigarettes with and without ten percent processed (high absolute humidity drying) fresh tobacco (PFT).

| | Tob. Wt. mg | Firmness (cts)[1] |
|---|---|---|
| With 10% PFT | 817 | 129 |
| Without PFT | 820 | 142 |

[1]Firmness is determined using a Firmness Profile Integrating Tester manufactured in England by R. W. Mason Engineering. A row of 12 arms fall on a cigarette with a 60 gram force, thereby indenting it. The indentations caused by those bars landing on the tobacco section are measured and averaged. An indentation of 7/1,000 of an inch is assigned a value of one count. Thus, the greater resistance to indentation, the firmer the cigarette, the lower the counts measured.

TABLE V(b)

Results of chemical analyses of smoke from cigarettes with and without 10 percent PFT (high absolute humidity drying).

| | mg/cig. Nic. | mg/cig. Tar | Puffs |
|---|---|---|---|
| With 10% PFT | 1.13 | 15.7 | 8.1 |
| Without PFT | 1.01 | 15.1 | 7.8 |

Cigarettes containing the PFT were more firm than those made with a conventional tobacco when using equal weights of tobacco in each type of cigarette.

EXAMPLE 6

A blend of tobacco was prepared exactly as in Example 5 except that the processed fresh tobacco in the blend was dried by freeze drying as in Example 3. Furthermore, the blend of the tobacco was 33 percent burley and 67 percent Virginia wherein leaves from all stalk locations were represented in the burley whereas in the Virginia, only the upper middle stalk locations were used. Cigarettes were made and evaluated yielding the results shown in the following Tables.

TABLE VI(a)

Physical evaluations of cigarettes with and without 10 percent processed (freeze drying) fresh tobacco.

| | Tob. Wt. mg | Firmness (cts)[1] |
|---|---|---|
| With 10% PFT | 737 | 142 |
| Without PFT | 822 | 142 |

TABLE VI(b)

Results of chemical analyses of smoke from cigarettes with and without 10 percent processed (freeze drying) fresh tobacco.

| | mg/cig. Nic. | mg/cig. Tar | Puffs |
|---|---|---|---|
| With 10% PFT | 1.03 | 13.3 | 7.1 |
| Without PFT | 1.03 | 14.0 | 7.6 |

In these cigarettes, those containing PFT were made at much lower density and were equally firm when compared with conventionally made cigarettes.

EXAMPLE 7

Burley tobacco at 87 percent moisture was processed as in Example 1 through the shredding step. Following shredding, the drying was started by spreading the tobacco in a thin layer (one to two inches in thickness) and allowing it to dry with periodic turning at room conditions until the moisture content had dropped to about 78 percent. The tobacco was then dried under high absolute humidity conditions to 20 percent moisture. Fill capacities were measured and compared with those of tobacco dried completely under high absolute humidity conditions. Results are in Table VII.

TABLE VII

| | Fill Value cc/gm |
|---|---|
| Fresh Shredded Tobacco | 19.9 |
| Air Dried to 78% Moisture | 15.0 |
| Air Dried to 78% Then High Absolute Humidity Dried to 20% Moisture | 11.6 |
| High Absolute Humidity Dried From 87% to 20% Moisture | 11.8 |
| Conventionally Air-cured - Conventionally Processed Burley | 5.9 |

The fill capacity of the combined drying steps (air drying plus high humidity drying) compared favorably with that of processed fresh tobacco dried completely in the high humidity dryer.

EXAMPLE 8

Two burley tobacco samples at 83 percent moisture were processed exactly as in Example 7 except the drying equipment was operated at the following conditions. In the sample identified as 8A, three passes were made through the dryer, the first pass being at 565° F. dry bulb temperature and 180° F. wet bulb temperature, the second and third passes being at 550° F. dry bulb and 208° F. wet bulb. In the sample identified as 8B, three passes were made through the dryer at 550° F. dry bulb and 207° F. wet bulb temperature. Residence time for all passes was about 7 seconds. After drying the fill value was measured and the results are shown in Table VIII.

TABLE VIII

| | Fill Capacity (cc/gm) | Moisture (%) |
|---|---|---|
| Fresh Shredded Tobacco, No Drying | 15.3 | 83.0 |
| Sample 8A | 10.0 | 13.8 |
| Sample 8B | 9.4 | 10.6 |
| Conventionally Air-cured - Conventionally Processed Burley | 5.94 | 9.7 |

The fill capacity of samples 8A and 8B were comparable to that of the processed fresh tobacco in Example 1.

EXAMPLE 9

Tobacco was collected during fresh processing of burley lamina after shredding but before drying. This material was used for selective microbial treatments to modify its composition. The steps in this process were to grow the inoculating culture, apply it to the tobacco, incubate it for a desired time, then dry the tobacco. Cultures of *Pseudomonas putida, Micrococcus denitrificans,* and Cellulomonas sp. were used to remove nicotine and/or nitrate. Each culture was grown in shake flask culture in tobacco extract until mature. The cultures were added to the shredded fresh tobacco and allowed to incubate in limited air at 25° C. to 30° C. for 16 hours, then dried by high absolute humidity air. The materials were then ready to be used in tobacco products. Results of analyses of samples taken before and after these types of treatments are shown in the following Tables.

TABLE VIII(a)

Results of analyses of processed fresh tobacco (high absolute humidity drying) with or without Cellulomonas sp. treatment.

| | % Alk. | % Nitrate | Fill Value cc/gm |
|---|---|---|---|
| With Cellulomonas sp. Treatment | 0.13 | 0.27 | 9.20 |
| Without Cellulomonas sp. Treatment | 1.05 | 1.94 | 9.84 |

TABLE VIII(b)

Results of analyses of processed fresh tobacco (high absolute humidity drying) with or without *Pseudomonas putida* treatment.

| | % Alk. | % Nitrate | Fill Value cc/gm |
|---|---|---|---|
| With *Pseudomonas putida* | | | |

TABLE VIII(b)-continued

Results of analyses of processed fresh tobacco (high absolute humidity drying) with or without *Pseudomonas putida* treatment.

| | % Alk. | % Nitrate | Fill Value cc/gm |
|---|---|---|---|
| Treatment | 0.33 | 1.01 | 9.49 |
| Without *Pseudomonas putida* Treatment | 1.05 | 1.94 | 9.84 |

TABLE VIII(c)

Results of analyses of processed fresh tobacco with or without *Micrococcus denitrificans* treatment.

| | % Alk. | % Nitrate | Fill Value cc/gm |
|---|---|---|---|
| With *Micrococcus denitrificans* Treatment | 0.59 | Trace | 8.97 |
| Without *Micrococcus denitrificans* Treatment | 1.34 | 0.61 | 9.03 |

What is claimed is:

1. A method for processing freshly harvested tobacco having from 65% to 90% moisture comprising the steps of:

(a) reducing the particle size of the harvested tobacco into a preselected size; and (b) drying the tobacco, said steps being completed without the natural curing of the tobacco.

2. The method of claim 1 wherein reducing the particle size includes the steps of removing the midribs from tobacco lamina then cutting into a preselected size.

3. The method of claim 1 wherein reducing the particle size includes the steps of cutting the tobacco lamina into a preselected size and after the drying step, the midribs are removed from the cut tobacco.

4. The method of claim 1 wherein the moisture of the tobacco in the reducing of the particle size step is from 65 percent to 90 percent by weight.

5. The method of claim 1 wherein the drying of the tobacco reduces the moisture of the tobacco to from 3 percent to 20 percent by weight.

6. The method of claim 1 wherein drying includes freezing the tobacco; storing the tobacco at a temperature of at least −15° C.; and, subliming the frozen tobacco.

7. The method of claim 1 wherein drying includes air drying, in a controlled environment of from 60° F. to 100° F. at a relative humidity of at least 50 percent.

8. The method of claim 1 wherein drying includes high absolute humidity drying, said high absolute humidity drying being performed at at least 165° F. wet bulb, and at least 280° F. dry bulb.

9. The method of claim 1 including a treating step between the reducing and drying steps, said treating step including means to remove selected components from the tobacco.

10. The method of claim 9, said treating step including subjecting the tobacco to microbial treatment for removal of selected components from the tobacco.

11. The method of claim 9, said treating step including subjecting the tobacco to extracting means for removal of selected components from the tobacco.

* * * * *